United States Patent [19]

Warmath

[11] 4,274,564

[45] Jun. 23, 1981

[54] UNITARY GARMENT RETAINING HANGER

[75] Inventor: John Warmath, Brooklyn, N.Y.

[73] Assignee: Cut Rate Plastic Hangers, Inc., Brooklyn, N.Y.

[21] Appl. No.: 22,963

[22] Filed: Mar. 23, 1979

[51] Int. Cl.[3] ..... A41D 27/22

[52] U.S. Cl. ..... 223/93; 24/137 R; 24/255 SL

[58] Field of Search ..... 223/90, 91, 93, 96; 16/87.2; 24/137 R, 138, 255 R, 255 SL, 260

[56] References Cited

U.S. PATENT DOCUMENTS

| | | | |
|---|---|---|---|
| 2,626,439 | 1/1953 | Mack | 24/137 R |
| 3,140,024 | 7/1964 | Burns et al. | 223/93 |
| 3,209,966 | 10/1965 | Wach | 223/93 |
| 3,516,631 | 6/1970 | Santucci | 24/255 SL |
| 3,982,307 | 9/1976 | Smith et al. | 24/137 R |
| 4,193,174 | 3/1980 | Stephens | 24/255 SL |

*Primary Examiner*—Louis Rimrodt
*Attorney, Agent, or Firm*—Bauer & Amer

[57] ABSTRACT

A unitary garment-retaining hanger includes a pivotally hinged arm integrally formed on the hanger body and defining a normally open garment-receiving cavity between the arm and the hanger body, the hinged arm being pivotally movable from a clearance position for positive latched engagement with a keeper notch on the hanger body to close the garment-receiving cavity.

13 Claims, 3 Drawing Figures

UNITARY GARMENT RETAINING HANGER

BACKGROUND OF THE INVENTION

The present invention relates to garment hangers capable of supporting a wide variety of garment types and for positively retaining a supported garment.

In addition to the conventional use of hangers for conveniently and attractively displaying garments in retail establishments, the clothing industry has recognized that significant advantages may be attained by placing a garment on a hanger at the point of manufacture and then shipping the hung garment to the stores together with the hanger. The use of so-called ship-on hangers has been found to be of particular advantage to the retail merchant whose employee labor costs are reduced by reason of minimized garment handling or manipulation which further results in a reduction of inadvertent soiling of garments prior to display and sale.

Typically, the garments are shipped unsecured to the accompanying hangers and there is a tendency, in the normal jostling and the like associated with shipping, for the garments to become separated or detached from the hangers associated therewith. This is particularly problematical where the garments are manufactured of silk or similarly thin or flimsy material which has a decided tendency to slide off conventional hangers. Separation of the garment from its hanger during shipping often results in severe wrinkling or deformation of the garment, thus substantially obviating the economic advantages of utilizing ship-on hangers, while such an occurrence at the retail establishment may result in severe soiling or damage to the garment rendering the same unsaleable should the garment fall to the floor and be trampled underfoot.

The hanger art suggests a number of hanger constructions which include some type of garment retaining or clamping means thereon. Of course, it should be recognized that inasmuch as these hangers are generally intended to be shipped with the garment from the manufacturer to the retailer, manufacturing costs of the hangers must be carefully considered. Hanger costs of the garment manufacturer will be passed on to the retailer and ultimately to the consumer, and simplicity of hanger design and fabrication are therefore essential from a practical standpoint.

As a consequence, garment-retaining hangers wherein non-integrally formed clamps comprising a number of individual component parts pivotally or otherwise secured to the hanger body are often too costly in manufacture and assembly for large-scale use with moderately-priced garments. U.S. Pat. No. 3,140,024 to Burns et al is typical of this art.

Other known hanger designs, wherein the clamps are integrally formed or molded with the hanger body, are generally constructed so that the clamps are biased normally closed. Manipulation of both hanger and garments can become understandably difficult during garment insertion for retention in the clamps during which the clamps must be manually held and maintained in an open position while a portion of the garment is inserted. In addition, since the same material flexibility that commonly enables manual movement of the integral clamps from their closed to open positions for garment insertion permits unintended opening or release of the clamps under the external jostling forces to which the garments are subjected during shipping, positive clamped retention of the garment is not assured unless auxiliary loading members or elements are used in conjunction with the clamps. This type of hanger construction is exemplified by U.S. Pat. No. 3,209,966 to Wach.

It is, therefore, the desideratum of the present invention to provide a unitary hanger construction including integral garment retaining means which are biased in a normally open position and which latch closed to provide for positive retention and prevent unintended release of a garment held thereby.

It is, further, an object of the present invention to provide a garment-retaining hanger wherein an integral retaining means is recessed into the shoulders of the hanger so that when the retaining means are closed the hanger shoulders conform to the shoulder line of a garment for conventionally supporting a garment as though the hanger were formed without the recessed retaining means.

It is another object of the present invention to provide a garment-retaining hanger wherein manually-induced resilient deformation of a portion of an integral garment retaining means is required for opening the same so as to prevent unintended disengagement or loss of the garment therefrom.

It is a further object of the present invention to provide a unitary garment-retaining hanger of particularly simple construction which may be molded at advantageously low cost.

Further objects, features and advantages of the present invention will be more fully appreciated by reference to the following detailed description of a presently preferred, but nonetheless illustrative embodiment in accordance with the present invention, when taken in conjunction with the accompanying drawings, wherein.

DETAILED DESCRIPTION OF THE PREFERRED EMBODIMENT

The present invention relates to unitarily-formed garment hangers which include integral structures for positive latched retention of a garment. Specifically, the invention is directed toward a clamping or retaining means unitarily formed with a hanger and which provides particularly noteworthy advantages over analogously utilized structures known in the art.

Figure 1:
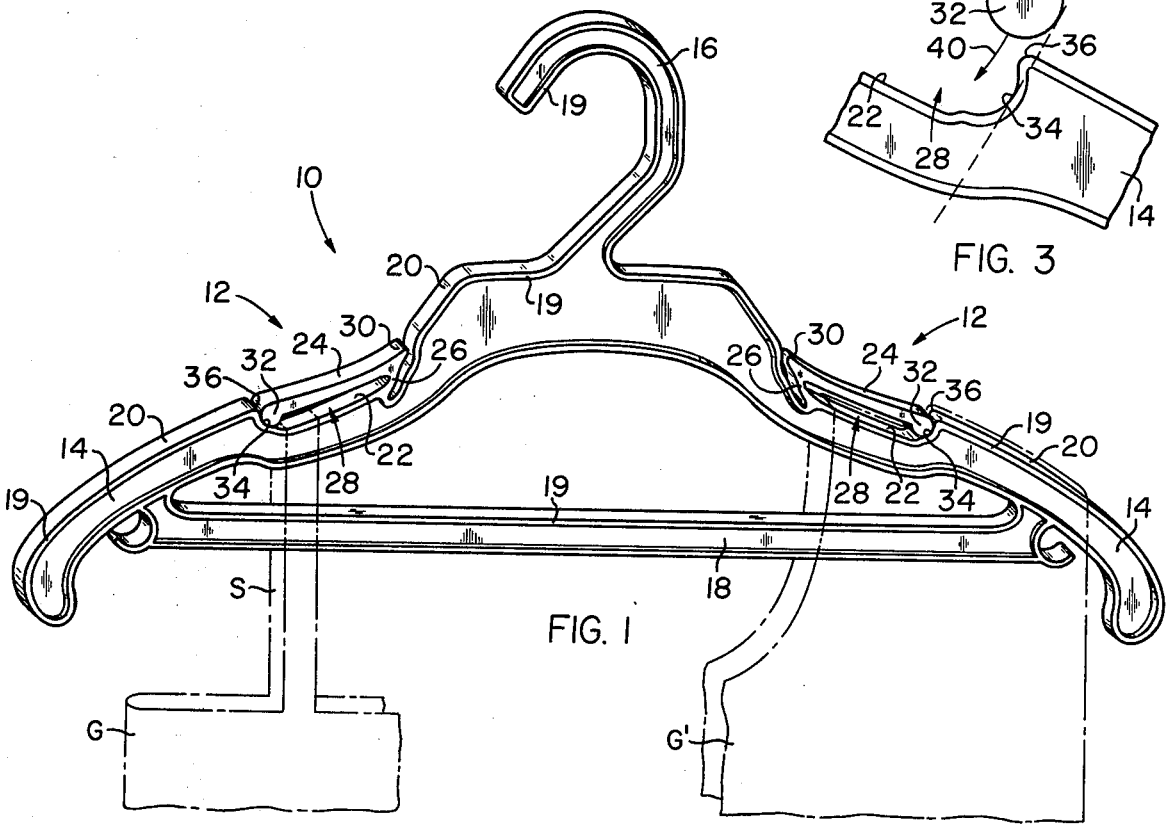
FIG. 1 is an elevational view of a hanger in accordance with the present invention wherein the integral garment-retaining means are seen in their operative or closed condition retaining a garment.

There is seen in FIG. 1 a unitary garment hanger generally designated 10 of generally conventional shape and including integral garment retaining or clamping means denoted by the general reference numeral 12 on each of the opposed hanger shoulders 14. The hanger 10 is further provided with a conventional hook-shaped member or element 16 extending upwardly from the juncture of the shoulders 12 for supported engagement of the hanger 10 with and ready disengagement from a rod or the like. A cross bar 18 over which a pair of pants may be hung but which comprises no part of the present invention is shown connecting the hanger shoulders 14 proximate their outwardly disposed ends.

It is contemplated and expected that the hanger 10 will be molded of a synthetic plastic resin or the like of suitable composition to provide substantial strength and rigidity with a relatively thin cross-sectional dimension. A strengthening rib 19 may be provided along the periphery of one or both faces of the principal plane of the hanger to increase the rigidity inherent in the material of construction and for thereby facilitating support of a garment hung on the hanger 10. However, as this description proceeds, it will become clear that operation of the garment retaining or clamping means 12 requires that certain portions of the unitarily-formed hanger exhibit a degree of flexible resilience and it is, therefore, essential that the material of construction of the hanger 12 be capable of such deformation. Many plastic compositions, such as polyurethanes and polyethylenes, possess the desired physical attributes and are well known to those skilled in the art, although the selection of a construction material is purely a matter of design choice so long as the completed hanger 10 functions in accordance with the teachings of the present disclosure.

Each of the hanger shoulders 14 includes a contoured upper garment-supporting surface 20 generally conforming to the typical shoulder line or slope of a garment and in which is defined an elongated recess or indentation 22. An elongated arm 24 disposed in the plane of the hanger shoulder 14 and in adjacent contiguity with the elongation of the recess 22 for substantially its entire length is supported by a connecting hinge or neck 26 which integrally links the arm 24 proximate one end thereof with the hanger shoulder 14.

Figure 2:
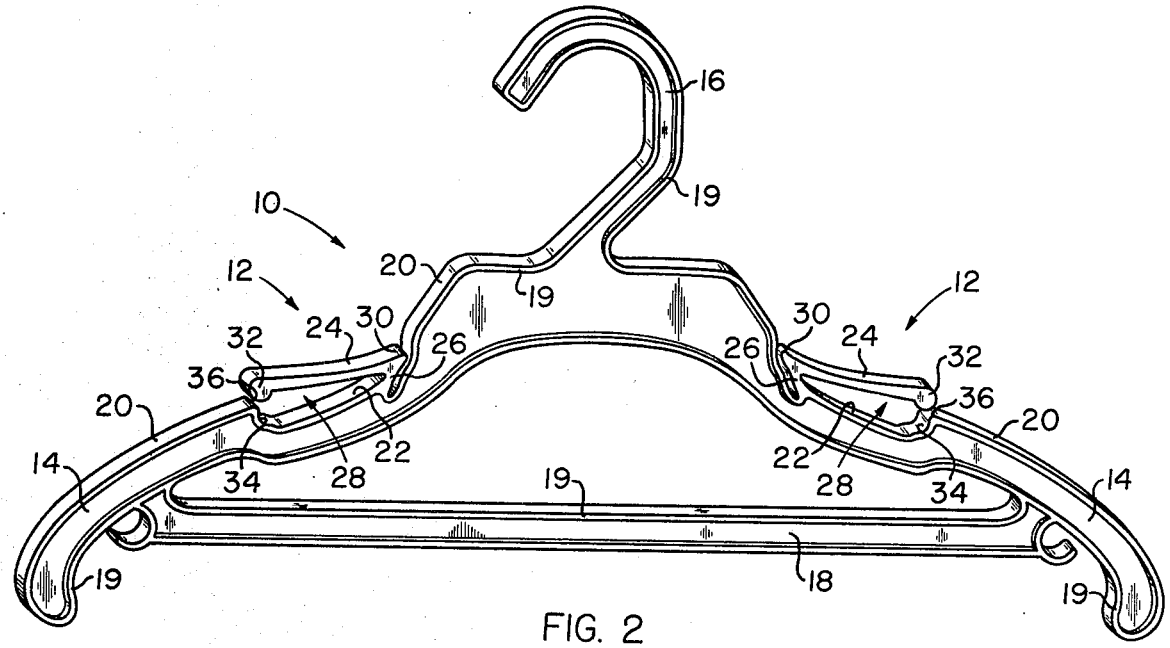
FIG. 2 is an elevational view of a hanger according to the present invention wherein the garment-retaining means are shown in their normally open condition.

As best seen in FIG. 2, the hinge or connecting link 26 is formed so as to normally bias the distal end of the arm 24 opposite the hinge 26 away from the hanger shoulder 14 to a clearance position spaced therefrom. Moreover, at least by reason of a predetermined configuration of the hinge 26 by which, for example, the same may be cross-sectionally narrowed, the hinge 26 exhibits a resilient flexibility for limited pivotal movement of the arm 24 by which its distal end normally spaced from the shoulder 14 is pivotally movable toward the shoulder in opposition to said normal outward bias for reasons that will become clear hereinafter. It will, therefore, be recognized that the disposition of the hinged arm 24 contiguously adjacent the recess 22 defines a normally open garment-receiving cavity designated 28 between the hanger shoulder 14 and the pivotally arranged arm 24.

At its proximal end adjacent the connection with the flexible hinge 26, the arm 24 is provided with a finger operator portion comprising an extension of the elongation of the arm 24 beyond its connection with the hinge 26. As will be more clearly explained as this description proceeds, a lever arm is created in response to the application of force or pressure to the finger operator portion 30 thereby enabling a mechanical advantage effective for causing pivotal movement of the distal or opposite end of the arm 24 in a direction away from the hanger shoulder 14.

Figure 3:
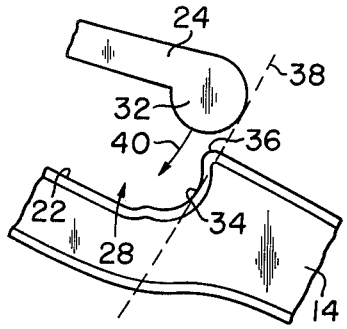
FIG. 3 is an enlarged view of a portion of the garment-retaining means of the present invention seen in its normally open condition.

A latching head 32 is integrally carried at the distal or free or outwardly disposed end of the pivotally hinged arm 24 and is preferably substantially arcuately configured along its outer peripheral surface, as best seen in the enlarged and slightly exaggerated view of FIG. 3. The latching head 30 is configured and disposed for positive latching engagement with a portion of the recess 22 so as to close the normally open garment-receiving cavity 28 for retention of a hanger-supported garment.

Specifically, the latching head 32 is engageable with a keeper notch 34 defined at the outwardly disposed end along the elongation of the shoulder recess 22. The keeper notch 34 substantially arcuately conforms to the configuration of the latching head 32 and includes a shoulder means or lip located at the convergence of the garment-supporting surface 20 of the shoulder 14 with the outwardly disposed end of the recess 22. As best seen in slightly exaggerated form in FIg. 3, and indicated by the imaginary dotted line designated 38 which denotes the path of the arcuate edge of the latching head 32 as the arm 24 is pivotally moved, the lip 36 projects into the path traversed by the latching head 32 as the arm 24 is moved toward the hanger shoulder 14 from its clearance position to carry the latching head 32 into engagement with the keeper notch 34. Engaging movement of the latching head is depicted by the arrow 40 in FIG. 3 and will be more fully explained as this description proceeds. For the present, it is sufficient to understand that the exaggerated illustrated projection of the lip 36 into the path of the latching head 32 insures that when the latching head is moved past the lip 36 and is seated within the keeper notch 34 a positive latched engagement sufficient to prevent unintended disengagement or displacement of the latching head 32 is attained. The configuration of the lip 36 may be such as to enable resilient deformation thereof as the latching head 32 contacts and moves past the lip for entry into the keeper notch 34. Thus, the rib 19 may be eliminated in the area of the lip 36 for increased resilient deformation of the lip.

As previously explained, each garment retaining means 12 of the hanger 10 is initially molded in the open or non-clamping condition seen in FIG. 2 wherein the connecting hinge 26 normally biases the distal or free end of the arm 24 to an outward or clearance position spaced from the hanger shoulder 14. Normally outwardly biasing the arm 24 so as to initially define a garment-receiving cavity 28 self-maintained in an open condition enables ready insertion of a portion of a garment into the cavity 28. As a consequence, garment insertion into the cavity 28 for subsequent retention to the hanger 10 is appreciably and conveniently simplified since the user need not manually hold open or otherwise maneuver the arm 24 in order to maintain an open garment-receiving cavity 28.

Thus, a portion of a garment to be retained on the hanger 10 is initially inserted into the open garment-receiving cavity 28. For purposes of illustrations, the left-hand portion of the hanger 10 of FIG. 1 shows a strap S of a garment G positioned within the cavity 28. It is intended that the elongations of the shoulder recess 22 and pivotally movable arm 24 be of sufficient length to enable enclosure within the cavity 28 of the entire width of a typical garment strap S.

Operation of the garment-retaining means 12 for closing the normally open garment-receiving cavity 28 is easily accomplished or effected by merely pressing downward, as with a user's finger, on the distal or unhinged end of the arm 24 so as to pivot the arm and move its latching head 32 into engagement with the substantially conforming keeper notch 24 on the hanger shoulder 14. The structural arrangement and configuration of the keeper notch 34 provides a positive latched engagement with the head 32 for firmly and inescapably retaining the same in the notch 34 subsequent to removal of the downward latching force manually applied to the distal end of the arm 24.

The latching engagement and positive retention of the head 32 in the keeper notch 34 is attained by reason of the lip 36 which projects into the path traversed by the latching head 32 and past which the head must move for entry into or disengagement from the keeper notch 34. Movement of the arm-carried latching head 32 from its initial clearance position outwardly spaced from the shoulder 14 and into latched engagement within the keeper notch 34 obviously requires that the latching head 32 move past and clear the projecting lip 36. In the preferred embodiment of the present invention seen in the drawing, either surface deformation of the lip 36 and/or latching head 32, or longitudinal movement of the arm 24 in a direction toward its connection with the hinge 26 so as to enable the latching head 32 to substantially clear the projecting lip 36 in its path, or some combination of the two, is utilized to permit the desired latched engagement. Put another way, as the latching head 32 is moved toward the hanger shoulder 14 from its normal clearanance position and comes into abutment with the projecting lip 36, the resilient flexibility of the hinge 26 may permit longitudinal movement of the arm 24 along its elongation until the head 32 moves past the lip 36 when the arm 24 is then automatically returned to its normal position by reason of the flexible resilience of the hinge member 26.

On the other hand, or in addition thereto, the structural arrangement or configuration of the lip 36 may be predeterminately provided to render the same sufficiently flexible and resilient so that the lip 36 resiliently deforms as the latching head 32 moves abuttingly past the same and thence returns to its normally undeformed condition subsequent to its deforming contact with the latching head 32.

In any event, once the latching head 32 is positioned within the defines of the substantially conforming keeper notch 34, the projection of the lip 36 into the path which must be traversed by the head 32 for disengagement and release of the hinged arm 24 serves to positively retain the latching head 32 and prevent its unintended escape or displacement from engagement with the keeper notch 34. The projecting lip 36 is effective to secure the head 32 against unintended displacement from its latched engagement even in the presence of significant externally-applied forces on or jostling movements of the hanger 10 or garment G secured thereto in the course of shipping from the manufacturer or during retail customer garment handling and examination.

Although the positive latched closure of the garment retaining means 12 is effective to substantially prevent unintended or inadvertent disengagement of the arm 24, intended release of the latching head 32 from the keeper notch 34 is readily and simply accomplished by an application of downwardly-directed force to the finger operator portion 30 of the hinged arm 24. A relatively small force or pressure applied to the operator portion 30 causes resilient deformation of the flexible hinge 26 by which the arm 24 is moved along its longitudinal axis to enable the latching head 32 to clear the projecting lip 36 and simultaneously pivots the hinged arm 24 upward at its distal end and thereby out of engagement with the interior defines of the notch 34. In actuality, downward force applied to the finger operator portion 30 may be discontinued or removed once the latching head 30 moves past the projecting lip 36 since the arm 24 will thence automatically return to its normal clearance position spaced from the hanger shoulder 14 under the urgency of the connecting hinge 26. Thus, it will be recognized that the finger operator portion 30 provides easily utilized, manually operated means for enabling the latching head 32 to clear the projecting lip 36 when it is desired to release the latching head from engagement with the keeper notch 34 and thereby open the garment-receiving cavity 28.

As seen in the right-hand portion of FIG. 1, the hanger 10 is also adapted for secured retention of a strapless garment G′ which includes a so-called natural shoulder line or contour. In utilizing the retaining means 12 for securing a strapless garment G′ on the hanger 10, a portion of the shoulder of the strapless garment G′ is inserted into the open garment-receiving cavity 28 and the hinged arm 24 pivotally moved so as to engage the latching head 32 within the keeper notch 34 as previously described. Although a portion of the garment G′ is thereby clamped or pressed between the abutting surfaces of the latching head 32 and keeper notch 34, the arcuately configured outer periphery of the head 32 and substantially arcuately conforming engaging surface of the keeper notch 34 are sufficiently smooth and without discontinuity as to prevent damage to the garment even when delicate or flimsy material is pressed therebetween. It is accordingly preferred that the projecting lip 36 of the notch 34 be rounded at its edge so as to further insure against the possibility of damage to the garment G′ clamped between the head 32 and notch 34.

The flexibly hinged arm 34 may be provided with its top surface contoured in the same manner as the garment-supporting surface 20 of the hanger shoulder 14 which substantially conforms to the shoulder line of a typical garment. By predeterminately positioning the hinged arm 24 relative to the hanger shoulder 14 and the recess 22 therein defined, the hanger 10 can be effectively provided with shoulders 14 having continuous surfaces 20 that are substantially smooth and uninterrupted along their lengths when the latching head of each garment-retaining means 12 is engaged in its corresponding keeper notch 34 to close the garment-receiving cavity 28. In this manner, when the garment-retaining means 12 is latched closed, the surface contour of the hanger shoulder 14 will be such as to substantially conform to the shoulder line of a garment as if the hanger were formed without the recess 22 or the hinged arm 24 and the hanger 10 may accordingly be utilized for supporting a shirt-type garment or the like in a conventional, unsecured manner (not shown) irrespective of whether an additional garment is simultaneously retained to the hanger 10 by the integral garment-retaining means 12.

It should accordingly be clear that the garment-retaining hanger 10 is adapted for supporting any of a wide variety of garment types and configurations in both secured and unsecured fashion. The retaining or clamping means 12 integrally and unitarily molded or otherwise formed with the hanger 10 provides for positive latched securement of a garment to the hanger 10 and is effective to prevent unintended or inadvertent release of the operating arm 24 under adverse conditions. At the same time, intended and desired garment release is easily and expeditiously accomplished by an application of light finger pressure to the operator portion 30 of the hinged latching arm 24.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. In a unitary garment hanger having at least a garment supporting shoulder, garment-retaining means on the hanger shoulder comprising:

an elongated arm disposed in and moving in the plane of the hanger shoulder, connecting means integral with said arm and integrally connecting said arm proximate one end thereof to the hanger shoulder so as to define a free end of said arm at an end thereof opposite said connection with the hanger shoulder, said connecting means normally biasing the arm such that its free end is normally urged away from the hanger shoulder, arcuately configured latching head means carried on the free end of said arm, a recess defined in the hanger shoulder adjacent the elongation of said arm to define a normally open garment-receiving cavity between the hanger shoulder and said arm, said recess including a deformable keeper notch substantially arcuately conforming to the configuration of said latching head and deformable for receiving said head in positive latching engagement with said notch to close said garment-receiving cavity and thereby enable retention of a portion of a garment within said recess and for maintaining the latched engagement of said latching head in said keeper notch and against the resilient bias of said connecting means to prevent an unintended escape of said latching head from engagement with said keeper notch, and a finger operator portion integrally carried on said one end of the arm for operating said arm in response to the application of finger pressure on said operator portion to effect pivotal disengaging movement about said connecting means in the plane of the hanger shoulder and release of said latching head from said keeper notch and thereby open said garment-receiving cavity for insertion or removal of a garment portion therewithin.

2. In a garment hanger according to claim 1 wherein the hanger shoulder is contoured to conform to the shoulder line of a garment, said elongated arm having a contoured surface substantially conforming to the contour of the hanger shoulder and said arm being predeterminately positioned relative to the hanger shoulder and said recess at said connection means so that when said latching head is engaged in said keeper notch to close said garment-receiving cavity the disposition of said arm on the hanger shoulder is such as to present a substantially smooth, continuous and uninterrupted hanger shoulder substantially conforming to the shoulder line of a garment as if the hanger were formed without said recess.

3. In a garment hanger according to claim 1, said keeper notch including an integral lip for facilitating positive retention of said latching head in said notch and abuttingly past which said latching head must be moved for latched engagement of the head in said keeper notch to close said garment-receiving cavity.

4. In a garment hanger according to claim 3, said lip being flexibly resiliently formed so as to enable the same to deform as said latching head is moved abuttingly past said lip into engagement with said keeper notch and to return to its normally undeformed condition subsequent to said abutment with the latching head.

5. In a garment hanger according to claim 3 wherein the hanger shoulder has a garment-supporting surface in which said recess is defined, said lip of the keeper notch being located at the convergence of the hanger garment-supporting surface with said recess therein defined.

6. In a garment hanger according to claim 1, said connecting means being selectively configured to render the same flexibly resilient such that operation of said arm by the application of finger pressure on said arm operator portion to open said garment-receiving cavity causes resilient deformation of said connecting means for effecting release of said latching head from positive latched engagement in said keeper notch.

7. In a unitary garment hanger having a pair of garment supporting shoulders, garment-retaining means on at least one of the hanger shoulders comprising:

an elongated arm movable in the plane of each shoulder, hinge means integrally formed with the hanger shoulder and with said arm and connecting the shoulder and arm proximate one end along the elongation of said arm, said hinge means being flexibly resilient and normally biasing the end of said arm opposite said hinge means to a clearance position spaced from the shoulder, arcuately configured latching head means on said opposite end of the arm, a deformable keeper notch defined in the hanger shoulder at a location spaced from said hinge means and substantially arcuately conforming to the configuration of said latching head means and deformable for receiving the same in said notch and for positively retaining said head means therein against the normal bias of said hinge means to define a closed garment-receiving cavity between the hanger shoulder and said arm, finger operator means on said one end of the arm for effecting pivotal disengagement of said latching head about said hinge means in the plane of said shoulder from said keeper notch on the application of pressure to said operator means to open said garment-receiving cavity for insertion and removal of a portion of a garment therewithin, said open condition of the garment-receiving cavity being automatically maintained after removal of finger pressure from said operator means by reason of said normal bias of said flexibly resilient hinge means normally urging said opposite end of said arm to a clearance position spaced from the hanger shoulder.

8. In a garment hanger according to claim 7, said finger operator means comprising an extension of the elongation of said arm beyond its connection with said hinge means and in a direction away from said opposite end of the arm for delineating a lever arm enabling a mechanical advantage effective for facilitating pivotal movement of said arm opposite end about said hinge means upon an application of pressure to said operator means.

9. In a garment hanger according to claim 7, said latching head means being unitarily and integrally formed on said opposite end of the elongated arm.

10. In a garment hanger according to claim 7, said shoulder means comprising a lip on an edge of said keeper notch, said lip being predeterminately positioned relative to said latching head means on said arm such that said lip projects into the path traversed by said latching head means as said arm is moved toward the hanger shoulder from its clearance position to carry said latching head means into engagement with said keeper notch.

11. In a garment hanger according to claim 10, said lip being configured for resilient deformation thereof as said latching head means contacts and moves past said lip so as to enable entry of said latching head means into said keeper notch for positive retention therein.

12. In a garment hanger according to claim 7 wherein the hanger shoulders each have a contoured garment-supporting surface thereon, said garment-retaining means being recessed into the hanger shoulder and the contoured garment-supporting surface thereof so that when said latching head means is engagedly retained in said keeper notch to define said closed garment-receiving cavity said elongated arm forms a continuation of the contoured garment-supporting surface of the hanger shoulder in the area of said recess so as to present a substantially uniterrupted garment-supporting surface of the hanger shoulder as though the same were formed without said recess and thereby enable the hanger to support a garment on the garment-supporting surfaces of the hanger shoulders in a conventional manner irrespective of whether a portion of a second garment is positioned within said closed garment-receiving cavity of said garment-retaining means.

13. In a garment hanger according to claim 7, said keeper notch being predeterminately configured and positioned such that movement of said opposite end of the arm toward the hanger shoulder from its normal clearance position to effect engagement of said latching head means in said keeper notch causes resilient deformation of said hinge means as the latching head means contacts and moves past said shoulder means for retention in said keeper notch.

* * * * *